US010281845B2

(12) United States Patent
Tsuda

(10) Patent No.: US 10,281,845 B2
(45) Date of Patent: May 7, 2019

(54) DEVELOPMENT DEVICE AND IMAGE FORMING APPARATUS

(71) Applicant: CANON KABUSHIKI KAISHA, Tokyo (JP)

(72) Inventor: Shunsuke Tsuda, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 165 days.

(21) Appl. No.: 15/585,491

(22) Filed: May 3, 2017

(65) Prior Publication Data

US 2017/0329258 A1 Nov. 16, 2017

(30) Foreign Application Priority Data

May 10, 2016 (JP) ..... 2016-094612

(51) Int. Cl.
*G03G 15/08* (2006.01)
*G03G 15/09* (2006.01)
*G03G 9/107* (2006.01)

(52) U.S. Cl.
CPC ..... *G03G 15/0928* (2013.01); *G03G 9/107* (2013.01); *G03G 15/0808* (2013.01); *G03G 15/0812* (2013.01); *G03G 15/0891* (2013.01); *G03G 2215/0607* (2013.01); *G03G 2215/0822* (2013.01); *G03G 2215/0827* (2013.01)

(58) Field of Classification Search
None
See application file for complete search history.

(56) References Cited

U.S. PATENT DOCUMENTS

| | | | | |
|---|---|---|---|---|
| 9,304,446 | B2 * | 4/2016 | Akita | G03G 15/0921 |
| 9,599,926 | B2 | 3/2017 | Ishida et al. | |
| 2010/0202805 | A1 * | 8/2010 | Miyoshi | G03G 15/0921 399/277 |
| 2013/0287449 | A1 * | 10/2013 | Matsumoto | G03G 15/0812 399/272 |
| 2017/0060023 | A1 | 3/2017 | Takahashi | |

FOREIGN PATENT DOCUMENTS

| | | | |
|---|---|---|---|
| JP | H02-77772 | A | 3/1990 |
| JP | 2015-169696 | A | 9/2015 |
| JP | 2015-222303 | A | 12/2015 |
| JP | 2015-222317 | A | 12/2015 |

* cited by examiner

*Primary Examiner* — Roy Y Yi
(74) *Attorney, Agent, or Firm* — Venable LLP

(57) ABSTRACT

A development device includes a developer bearing, a regulation portion, and a magnetic field generation member that is provided inside of the developer bearing member. The magnetic field generation member includes a development pole a first magnetic pole, and a second magnetic pole. The magnetic field generation member has a region satisfying $|(Br(\theta a)-Br(\theta c))/10|<0.3$, wherein $Br(\theta a)$ is a magnetic flux density in a normal direction relative to the surface of the developer bearing member on a position shifted by −5° from a point nearest to the regulation portion on the developer bearing member around a center of the developer bearing member, and $Br(\theta c)$ is the magnetic flux density around the developer bearing member on a position shifted by +5° from the point nearest to the regulation portion on the developer bearing member.

7 Claims, 8 Drawing Sheets

*FIG. 7*

| | r (mT/θ) | R (mT/θ) | COATING AMOUNT (FLUCTUATION -5°) (mg/cm²) | COATING AMOUNT (FLUCTUATION +5°) (mg/cm²) | AMOUNT OF CHANGE IN COATING AMOUNT (mg) | CARRIER DEPOSITION |
|---|---|---|---|---|---|---|
| PRESENT EMBODIMENT | 0.29 | 0.59 | 32.2 | 27.6 | 4.6 | ○ |
| COMPARATIVE EXAMPLE | 0.89 | 0.37 | 34.6 | 26.0 | 8.6 | ○ |

DEVELOPMENT DEVICE AND IMAGE FORMING APPARATUS

BACKGROUND OF THE INVENTION

Field of the Invention

The present invention relates to a development device that is adaptable to an image forming apparatus using an electrophotographic image forming process, such as a laser beam printer, a copying machine, or a facsimile device, and an image forming apparatus.

Description of the Related Art

A two-component development system using a mixture of non-magnetic toner and magnetic carriers as developer has widely been used in a development device mounted to an image forming apparatus using toner as developer.

With the two-component development system described above, a developer is carried on the surface of a development sleeve due to magnetic force of a magnet roller stored in the development sleeve (developer bearing member), and the amount of the carried developer is regulated by a development blade to form a thin developer layer on the development sleeve. Then, the developer layer is conveyed to a development region facing a photosensitive drum due to the rotation of the development sleeve, and electrostatically adsorbed on the photosensitive drum with the developer being napped in a brush chain due to the magnetic force of the magnet roller. Thus, an electrostatic latent image is developed.

In the development device described above, a configuration for stabilizing an amount of developer carried on a development sleeve has conventionally been proposed. For example, Japanese Patent Laid-Open No. 2015-169696 discloses a configuration in which magnetic force in a tangential direction relative to the surface of a development sleeve is oriented in the direction same as the rotation direction of the development sleeve within a region from a scooping pole which scoops developer up to the development sleeve to a regulation pole which is a magnetic pole near the development blade. With this configuration, the developer is effectively conveyed by the development sleeve, whereby the amount (coating amount) of developer carried on the development sleeve is stabilized.

In general, a magnet roller has, for a peak position of a magnetic flux density in the normal direction relative to the surface of a development sleeve, an error of ±3° in the rotation direction of the development sleeve from a set peak position and a fluctuation of ±2° for a half width, as a component tolerance. Therefore, the magnetic flux density in the normal direction has a maximum fluctuation of ±5° on a region facing the development blade.

Herein, a napping angle of developer regulated by the development blade is defined by arctan (Br/Bθ) that is an arctangent function of a magnetic flux density Br which is a component in the normal direction and a magnetic flux density Bθ which is a component in the tangential direction, in the magnetic flux density exerted from the magnet roller. Therefore, when the magnetic flux density Br of a magnetic pole in the normal direction or the magnetic flux density Bθ in the tangential direction varies due to the component tolerance, the napping angle varies, so that the amount of developer regulated by the development sleeve varies.

Therefore, even when an effort is made to obtain a desired magnetic force distribution as in the configuration disclosed in Japanese Patent Laid-Open No. 2015-169696, the distribution of the magnetic flux density Br or the distribution of the magnetic force varies due to the component tolerance to cause a machine difference in an amount of developer regulated by the development blade and an amount of developer conveyed to a development region. This might adversely affect image property.

Specifically, if a regulation amount of developer is less than a desired amount, a coating amount of developer on the development sleeve increases, by which a fog on a photosensitive drum, overflow of developer, or a lock due to an increase in torque is likely to be caused. On the other hand, if a regulation amount of developer exceeds a desired value, a coating amount of developer on the development sleeve is decreased, by which it is likely that a required image density is not output.

SUMMARY OF THE INVENTION

It is desirable to provide a development device that can stabilize an amount of developer carried on a developer bearing member.

The representative configuration of the present invention is a development device that forms a toner image on an image bearing member, the development device including:

a developer bearing member that is rotatable and carries developer including magnetic particles and toner;

a regulation portion that is disposed to face the developer bearing member for regulating an amount of developer carried on the developer bearing member;

a magnetic field generation member that is provided inside of the developer bearing member, the magnetic field generation member having: a development pole facing the image bearing member; a first magnetic pole which is disposed downstream of the development pole with respect to a rotation direction of the developer bearing member on a position adjacent to the development pole and has a polarity different from a polarity of the development pole; and a second magnetic pole which is disposed upstream of the development pole with respect to the rotation direction of the developer bearing member on a position adjacent respectively to the development pole and the first magnetic pole and has a polarity different from the polarity of the development pole;

wherein the magnetic field generation member has a region satisfying $|(Br(\theta a)-Br(\theta c))/10|<0.3$, wherein $Br(\theta a)$ is a magnetic flux density in a normal direction relative to the surface of the developer bearing member on a position shifted by −5° from a point nearest to the regulation portion on the developer bearing member around a center of the developer bearing member, and $Br(\theta c)$ is the magnetic flux density around the developer bearing member on a position shifted by +5° from the point nearest to the regulation portion on the developer bearing member.

Further features of the present invention will become apparent from the following description of exemplary embodiments with reference to the attached drawings.

BRIEF DESCRIPTION OF THE DRAWINGS

FIG. 7 is a table illustrating a result of an experiment for comparing a difference in coating amounts of developer on development sleeves due to variations in peak positions of magnetic flux densities of magnetic poles S1 in the normal direction.

DESCRIPTION OF THE EMBODIMENTS

First Embodiment

<Image Forming Apparatus>

Hereinafter, the overall configuration of an image forming apparatus A provided with a development device according to the present invention will firstly be described, with reference to the drawings, together with an operation during image formation. The image forming apparatus A according to the present embodiment is a full-color image forming apparatus of an electrophotographic system that forms an image onto a sheet S with toner of four colors, yellow Y, magenta M, cyan C, and black K.

The image forming apparatus A includes an image forming portion that forms a toner image and transfers the toner image onto the sheet S, a sheet feed portion that feeds the sheet S to the image forming portion, and a fixing portion that fixes the toner image onto the sheet S.

Figure 1:
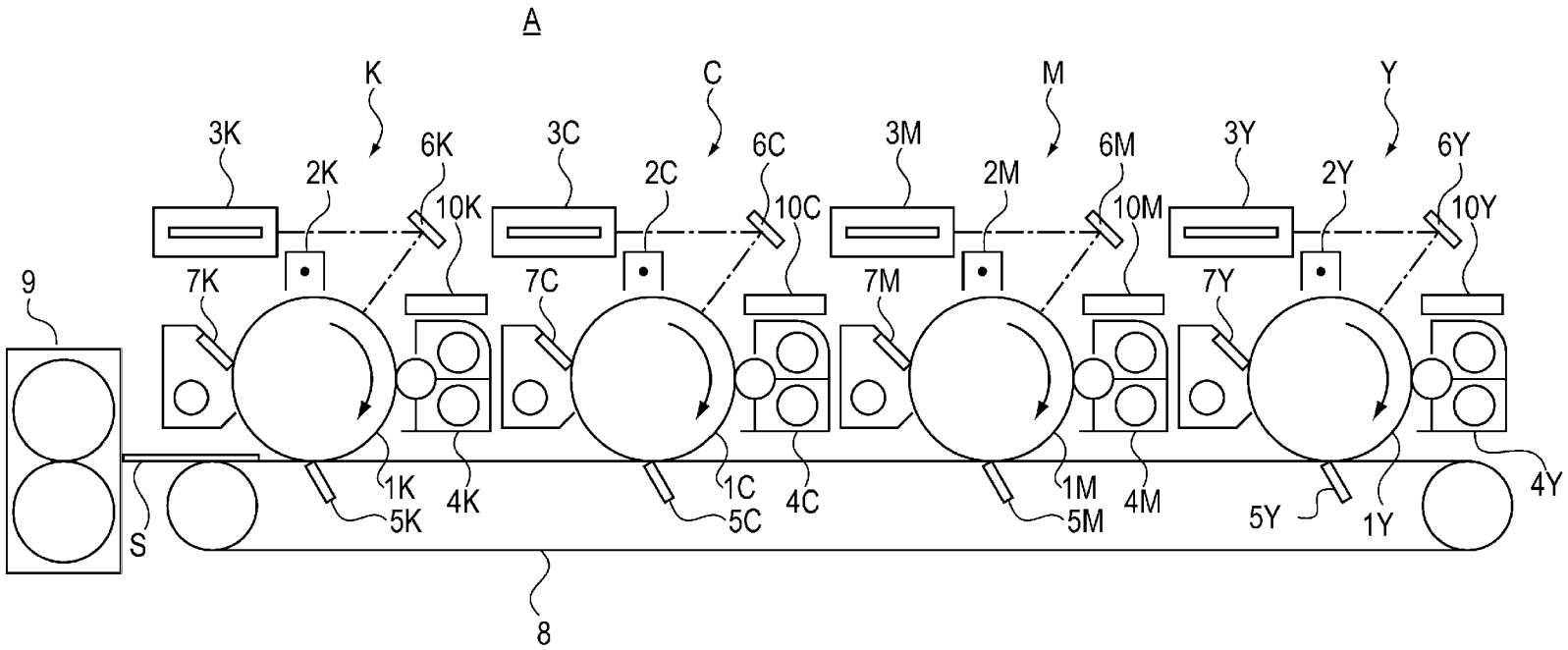
FIG. 1 is a schematic sectional view of an image forming apparatus.

As illustrated in FIG. 1, the image forming portion includes a photosensitive drum 1 (1Y, 1M, 1C, 1K) mounted so as to be rotatable and serving as an image bearing member, and a charging member 2 (2Y, 2M, 2C, 2K) that charges the photosensitive drum 1. The image forming portion also includes a laser scanner unit 3 (3Y, 3M, 3C, 3K), a development device 4 (4Y, 4M, 4C, 4K), a transfer member 5 (5Y, 5M, 5C, 5K), and the like.

In the image formation, when a controller which is not illustrated receives an image formation job, the sheet S stacked on a sheet stacking portion which is not illustrated is fed to the image forming portion.

In addition, in the image forming portion, the photosensitive drum 1 is uniformly charged by the charging member 2. Then, the laser scanner unit 3 emits laser light, which has been modulated according to an image information signal, from a light source not illustrated, and the surface of the photosensitive drum 1 is irradiated with the laser light through a mirror 6 (6Y, 6M, 6C, 6K), whereby an electrostatic latent image is formed.

Then, the electrostatic latent image formed on the photosensitive drum 1 is made visible as a toner image by the development device 4. Thereafter, the toner image is transferred onto the sheet S conveyed by a conveyance belt 8 through application of a bias having a polarity opposite to the charging polarity of toner to the transfer member 5. Then, the sheet S is conveyed to a fixing device 9 where heat and pressure are applied to the sheet S, whereby the toner image is fixed onto the sheet S. The sheet S is then discharged to the outside of the image forming apparatus A.

Note that the developer remaining on the photosensitive drum 1 after the transfer is removed by a cleaning device 7 (7Y, 7M, 7C, 7K). In addition, toner in the developer consumed by the image formation is supplied from a supply path not illustrated by a toner supply tank 10 (10Y, 10M, 10C, 10K).

Further, while the present embodiment is configured to directly transfer an image onto a sheet from the photosensitive drum 1, the present invention is not limited thereto, and may be configured such that, after toner images of respective colors are primarily transferred onto an intermediate transfer member, a composite toner image of each color is secondarily transferred onto a sheet collectively.

<Development Device>

Subsequently, the configuration of the development device 4 will be described.

Firstly, a developer used for development by the development device 4 will be described. In the present embodiment, a two-component developer is used as the developer which contains non-magnetic toner and magnetic carriers (magnetic particles), the toner and the carriers being mixed in a mixing weight ratio (toner weight÷weight ratio of toner and carriers) of 8%.

The toner contains binder resin and a colorant, and contains, as needed, colored resin particles containing other additives or colored particles to which external additives such as colloidal silica fine powders are added. The toner is negatively chargeable polyester resin, and in the present embodiment, the toner having a volume average particle diameter of 7.0 μm is used.

For the carriers, surface-oxidized or non-oxidized iron, nickel, cobalt, manganese, chrome, metal such as rare earth and alloy thereof, and oxide ferrite can be used, for example, and the method for preparing the magnetic particles is not particularly limited. In the present embodiment, carriers having a volume average particle diameter of 40 μm, resistivity of $5\times10^8$ Ωcm, and magnetization of 180 emu/cc are used.

Note that the magnetization of the magnetic carriers can be within the range of 100 to 300 emu/cc. The reason of this is as follows. Specifically, when the magnetization becomes less than or equal to 100 emu/cc, the magnetic restraint force between the development sleeve 26 bearing the developer and the carriers is decreased, so that the carriers are likely to be deposited onto the photosensitive drum 1. On the other hand, when the magnetization becomes more than or equal to 300 emu/cc, the rigidity of the developer layer carried on the development sleeve 26 increases, so that a sort of brush irregularities is likely to occur on the image due to the sliding friction of the developer layer.

Figure 2:
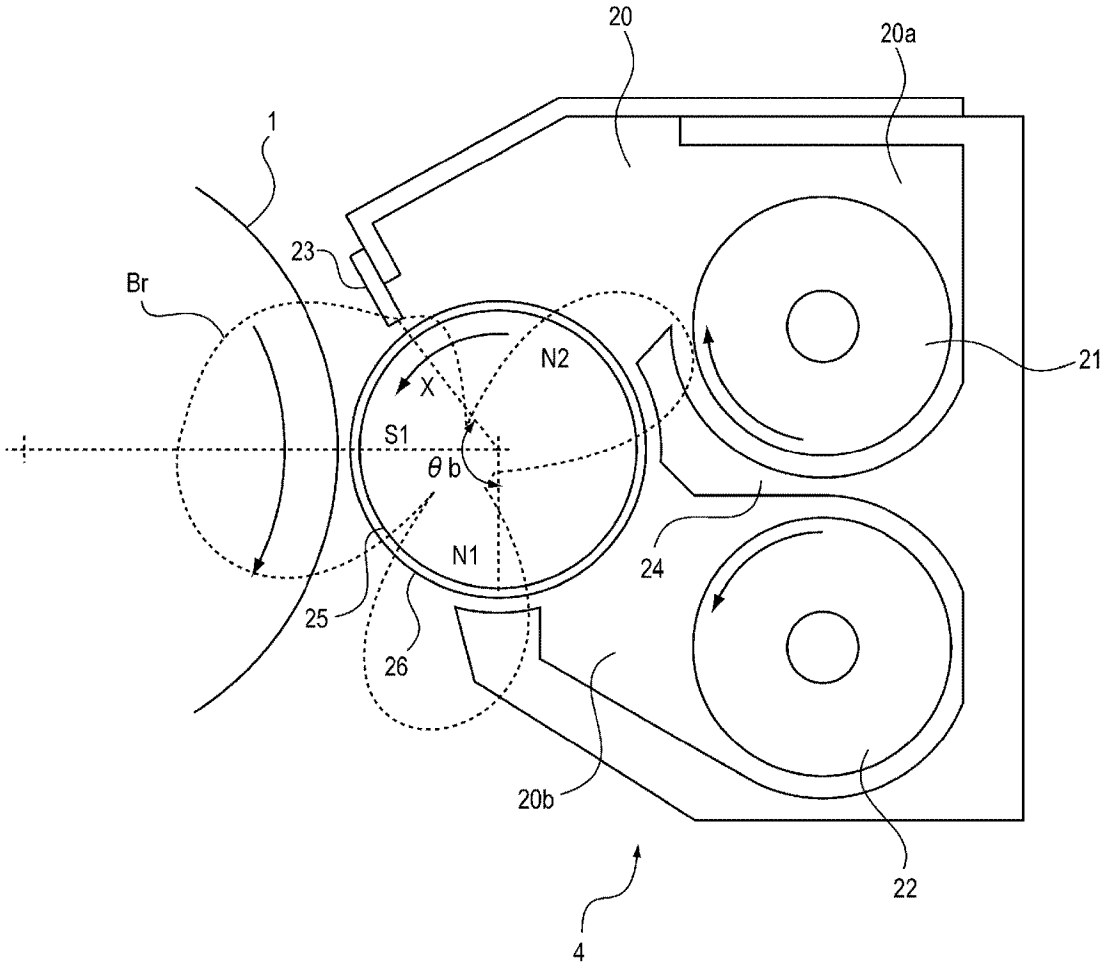
FIG. 2 is a schematic sectional view of a development device in the transverse direction.

Next, the internal structure and the basic operation of the development device 4 will be described. FIG. 2 is a sectional view of the development device 4 in the transverse direction, and FIG. 3 is a sectional view thereof in the longitudinal direction.

Figure 3:
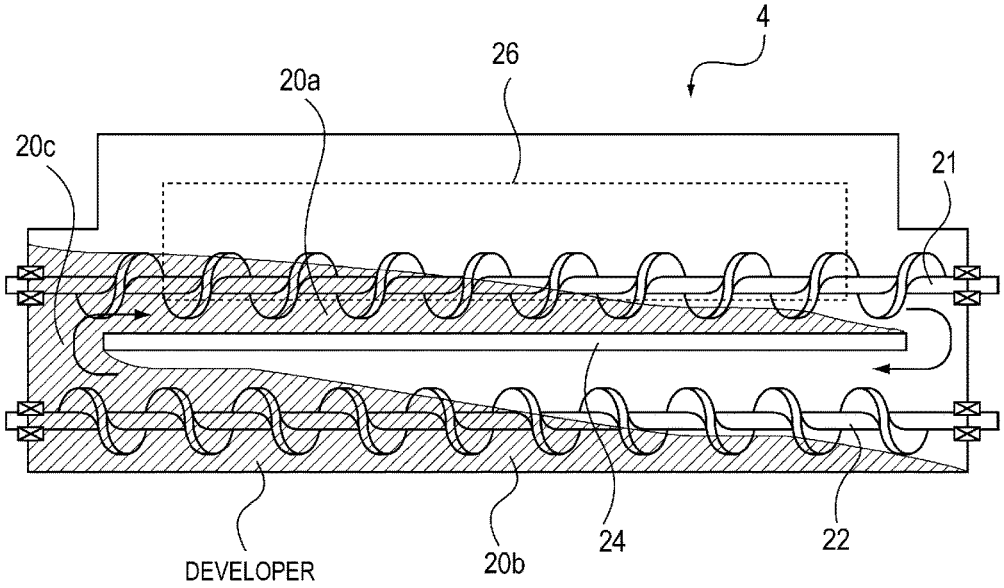
FIG. 3 is a schematic sectional view of the development device in the longitudinal direction.

As illustrated in FIGS. 2 and 3, the development device 4 has a developer storing portion 20 that stores a developer. The developer storing portion 20 is provided with a partition wall 24 inside, and vertically divided into an upper part which is a development chamber 20*a* and a lower part which is a stirring chamber 20*b* across the partition wall 24.

The development chamber 20*a* and the stirring chamber 20*b* are respectively provided with a first conveyance screw 21 and a second conveyance screw 22 for conveying the developer while stirring. The first conveyance screw 21 is disposed on the bottom of the development chamber 20*a* so as to be substantially parallel along the direction of the rotation shaft of the development sleeve 26. The first conveyance screw 21 has a screw structure in which a helical blade made of a non-magnetic material is provided on a rotation shaft, which is a ferromagnetic body, in a circumferential direction. The first conveyance screw 21 rotates to convey the developer along the axial direction of the development sleeve 26.

In addition, like the first conveyance screw 21, the second conveyance screw 22 provided in the stirring chamber 20*b* has the screw structure in which a helical blade made of a non-magnetic material is provided on a rotation shaft, which is a ferromagnetic body, in the circumferential direction, and is disposed on the bottom of the stirring chamber 20*b* so as to be substantially parallel to the first conveyance screw 21. However, the blade is oriented in the direction reverse to the blade of the first conveyance screw 21. The second conveyance screw 22 rotates in the direction same as the first conveyance screw 21 to convey the developer in the stirring chamber 20*b* in the direction reverse to the conveyance direction by the first conveyance screw 21.

In this way, the developer is conveyed, and circulates between the development chamber 20*a* and the stirring chamber 20*b* through communication portions 20*c* provided at both ends of the developer storing portion 20 in the longitudinal direction. At that time, the developer is pushed up from bottom to top due to the pressure of the developer accumulated on the downstream side with respect to the conveyance direction by the second conveyance screw 22, whereby the developer is delivered from the stirring chamber 20*b* to the development chamber 20*a*.

In addition, the developer storing portion 20 has an opening on the position facing the photosensitive drum 1, and the development sleeve 26 serving as the developer bearing member is rotatably mounted to the opening so as to be partially exposed to the photosensitive drum 1. The development sleeve 26 also has, on the position facing the photosensitive drum 1, a development region where the developer is deposited onto the photosensitive drum 1 for development.

Furthermore, the development sleeve 26 has stored therein a magnet roller 25 serving as a magnetic field generating member in a non-rotating state. This magnet roller 25 has a plurality of magnetic poles, and has a development pole S1 on the position corresponding to the development region of the development sleeve 26. That is, the magnetic pole S1 which is the development pole is arranged at the position facing the photosensitive drum 1. In addition, a magnetic pole N1 which is a first magnetic pole and has a polarity opposite to the polarity of the development pole and a magnetic pole N2 which is a second magnetic pole and has a polarity opposite to the polarity of the development pole are provided adjacent to each other across the magnetic pole S1.

When the development sleeve 26 rotates in the direction of an arrow X while carrying the developer thereon due to the magnetic force of each magnetic pole, the developer is conveyed to the development region. Specifically, the developer in the development chamber 20*a* is lifted up and carried on the development sleeve 26 by the magnetic pole N2 of the magnet roller 25. In addition, the developer is napped in a brush chain by the magnetic pole S1. Furthermore, the developer is stripped off from the development sleeve 26 due to a repulsive magnetic field formed by the magnetic pole N2 and the magnetic pole N1, and fed back to the stirring chamber 20*b*.

Figure 4:
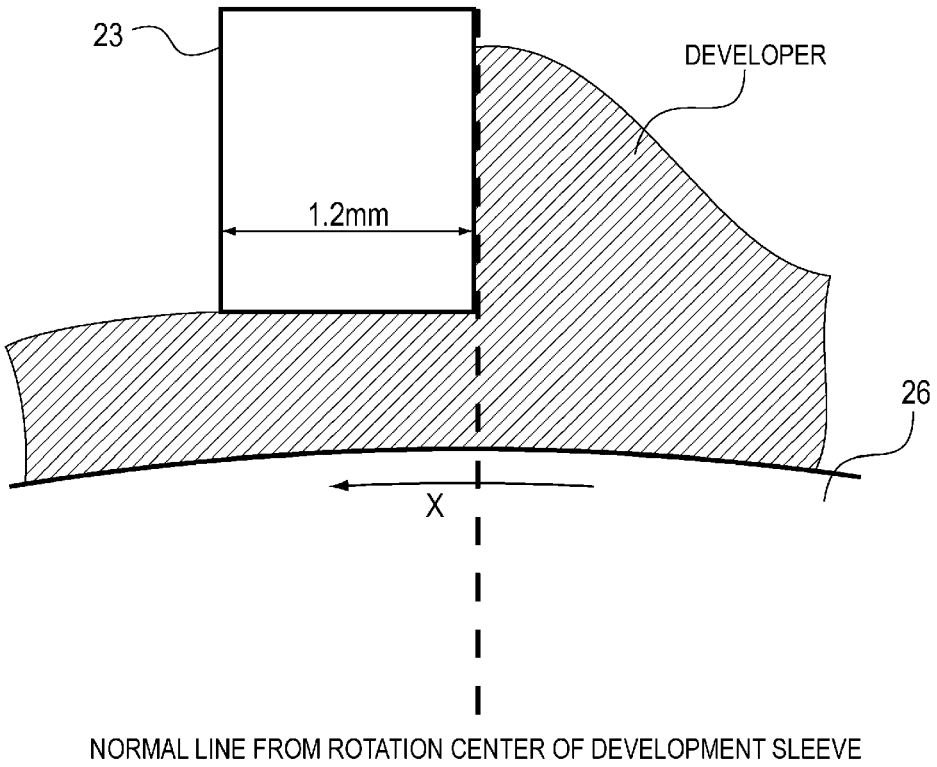
FIG. 4 is a schematic sectional view illustrating the configuration of a development blade.

In addition, a development blade 23 serving as a regulation portion is provided to face the development sleeve 26 in the vicinity thereof. In the present embodiment, as illustrated in FIG. 4, the development blade 23 is a non-magnetic member formed from a sheet-type aluminum with a thickness of 1.2 mm extending along the direction of the rotation shaft of the development sleeve 26. Further, the development blade 23 is configured such that the developer regulation surface extends in the normal direction from the center of the rotation of the development sleeve 26.

The development blade 23 regulates the amount of the developer carried on the development sleeve 26 to form a developer layer with a predetermined thickness on the development sleeve 26. Specifically, the developer carried on the development sleeve 26 passes between the leading end of the development blade 23 and the surface of the development sleeve 26 due to the rotation of the development sleeve 26, by which the amount of the developer is regulated and the developer layer is formed. The developer layer thus formed is conveyed to the development region due to the rotation of the development sleeve 26.

Note that the regulation amount of the developer is set by adjusting the distance between the leading end of the development blade 23 and the surface of the development sleeve 26. In the present embodiment, the gap (hereinafter referred to as SB gap) between the leading end of the development blade 23 and the surface of the development sleeve 26 is set to be 450 μm, and the amount of the developer coating the development sleeve 26 per unit area is set to be 30 mg/cm$^2$. Therefore, the development sleeve 26 is coated with the developer in an amount of at least 30 mg/cm$^2$ when the developer reaches the development blade 23.

In addition, in the present embodiment, the development blade 23 is provided near the magnetic pole S1 (within the region where the magnetic flux density Br of the magnetic pole S1 in the normal direction relative to the development sleeve 26 is not less than zero). That is, the magnetic pole S1 serves as both the development pole and a regulation pole in the present embodiment.

The developer layer thus formed is in contact with the photosensitive drum 1 in the development region with the developer being napped by the magnetic force of the magnetic pole S1 serving as the development pole, whereby the developer is supplied to the electrostatic latent image for development.

Notably, during the development, a development voltage obtained by superimposing a DC voltage and an AC voltage is applied to the development sleeve 26 to enhance development efficiency (toner deposition rate to the electrostatic latent image). In the present embodiment, the DC voltage of −500 V and the AC voltage having a peak-to-peak voltage of 800 V and a frequency of 12 kHz are applied. When the AC voltage is applied, the development efficiency is enhanced, but a fog is likely to occur. In view of this, a potential difference is formed between the DC voltage to be applied to the development sleeve 26 and the charging potential (white part potential) of the photosensitive drum 1 to prevent the fog.

In addition, in the present embodiment, the diameter of the development sleeve 26 is set to be 20 mm, the diameter of the photosensitive drum 1 is set to be 60 mm, and the distance between the development sleeve 26 and the photosensitive drum 1 at the position where they are closest to each other is set to be about 300 μm. Further, a blast process is performed on the surface of the development sleeve 26. Therefore, the developer is physically trapped by the irregularities on the surface of the development sleeve 26, whereby strong conveyance force is implemented in the circumferential direction due to the rotation of the development sleeve 26.

Moreover, in the development region, the development sleeve 26 rotates in the rotation direction of the photosensitive drum 1 with the circumferential speed ratio of 1.75 with respect to the photosensitive drum 1. The circumferential speed ratio is set to be 0.5 to 2.5. The larger the circumferential speed ratio is, the more the development efficiency is increased. However, when the circumferential speed ratio is too large, toner scattering or deterioration of the developer is likely to occur. In view of this, it is preferable that the circumferential speed ratio is set to be 1.0 to 2.0.

<Magnetic Flux Density by Magnetic Field Generation Member>

Next, the magnetic flux density generated by the magnet roller 25 serving as a magnetic field generation member will be described in detail.

Figure 5A:
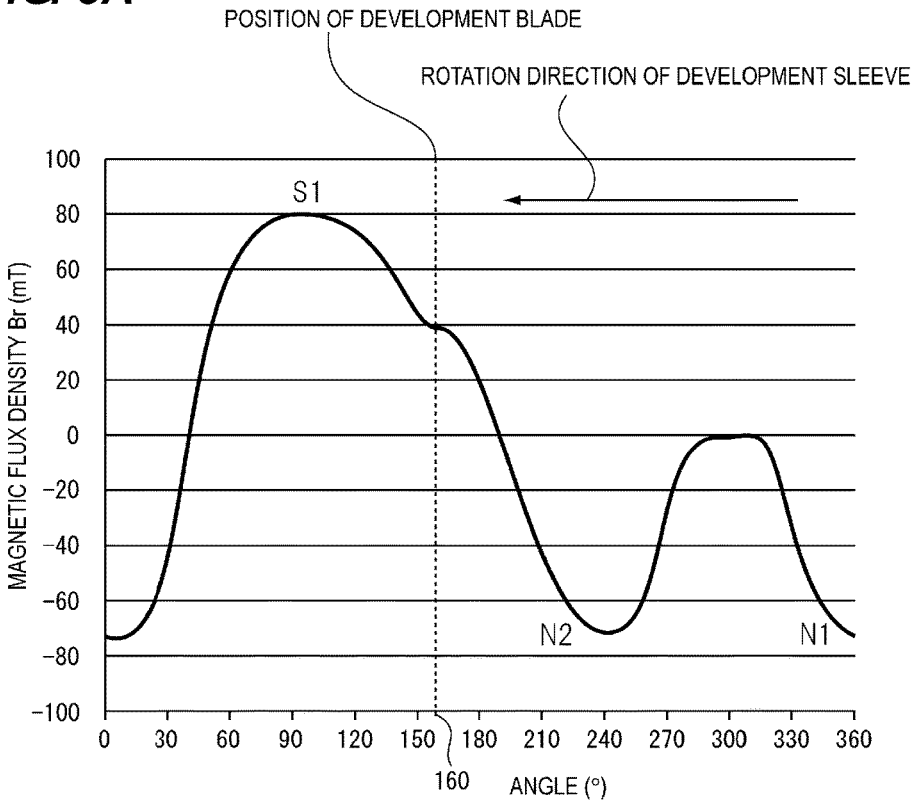
FIGS. 5A and 5B are a graph illustrating a distribution of a magnetic flux density in the normal direction with respect to the surface of the development sleeve, and a schematic diagram illustrating an angle θ which is obtained from arctan (Br/Bθ).

FIG. 5A is a graph showing the distribution of a magnetic flux density Br (hereinafter merely referred to as a magnetic flux density Br), exerted from the magnet roller 25, in the normal direction relative to the surface of the development sleeve 26. The angle indicated in the horizontal axis in FIG. 5A is set to increase in the clockwise direction (direction opposite to the rotation direction) along the circumferential direction of the development sleeve 26 with the angle just below the rotation center of the development sleeve 26 in FIG. 2 in the vertical direction (predetermined point) being defined as 0°. In addition, the magnetic flux density Br is set such that the S-pole side is positive.

Herein, the magnetic flux density Br of the magnetic pole S1 in the normal direction in the present embodiment is configured to have a peak (magnetic flux density Br=80 mT) on the position of 90°, to have a half width of 106°, and to be distributed from 40.5° to 189° (defined at 0 mT at both ends of the peak). In addition, the development blade 23 is provided to face the development sleeve 26 on the position of 160°.

Figure 5B:
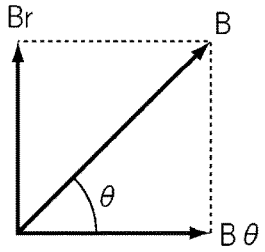

In addition, angle θ, which is obtained from arctan (Br/Bθ) that is an arctangent function of the magnetic flux density Br which is the normal-direction component of the magnetic flux density exerted from the magnet roller 25 and the magnetic flux density Bθ which is the tangential-direction component thereof, indicates an angle θ of the magnetic flux density from the tangential direction (FIG. 5B). Since the developer tends to be napped along the direction of the magnetic flux density, the angle θ of the magnetic flux density B from the tangential direction indicates the napping angle of the developer. Notably, the napping angle is set such that the angle in the tangential direction opposite to the rotation direction of the development sleeve 26 is defined as 0°, and the angle is increased in the counterclockwise direction (direction same as the rotation direction) along the circumferential direction of the development sleeve 26.

Figure 6:
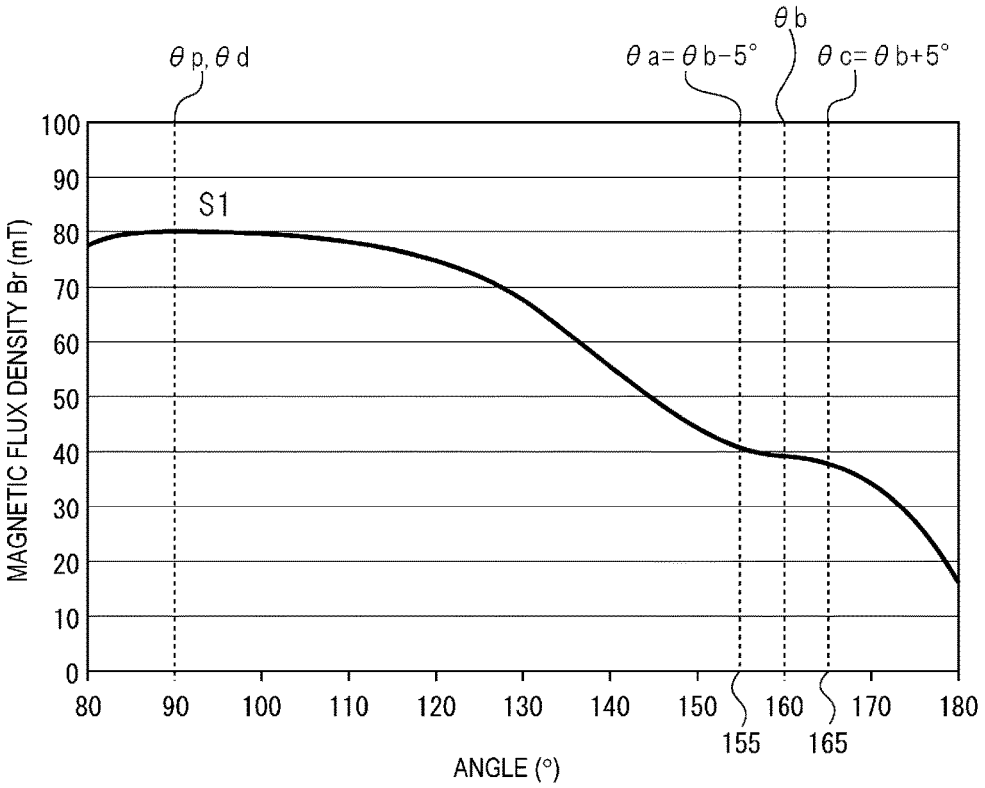
FIG. 6 is a graph illustrating a distribution of a magnetic flux density in the normal direction relative to the surface of the development sleeve.

FIG. 6 is a graph showing the region from 80° position to 180° position in the graph in FIG. 5A. As illustrated in FIG. 6, the point where a line segment connecting the tip of the development blade 23 and the rotation center of the development sleeve 26 intersects the development sleeve 26 is defined as a blade nearest point, and an angle corresponding to this point is defined as a blade nearest angle θb. In addition, an angle formed by adding −5° to the blade nearest angle θb in the rotation direction of the development sleeve 26 is defined as an angle θa, and an angle formed by adding +5° to the blade nearest angle θb is defined as an angle θc. Moreover, the angle at the peak position of the magnetic flux density Br of the magnetic pole S1 in the normal direction is defined as an angle θp. In addition, an angle at which the magnetic flux density Br of the magnetic pole S1, which is the development pole, in the normal direction is zero and on a position upstream of the development blade 23 with respect to the rotation direction of the development sleeve 26 is defined as θe.

Further, a point where a line segment passing through the rotation center of the development sleeve 26 and the rotation center of the photosensitive drum 1 intersects the development sleeve 26 is defined as a drum nearest point, and an angle corresponding to this point is defined as a drum nearest angle θd. Note that the drum nearest point corresponds to the development region. When toner on the development sleeve 26 is caused to jump to the photosensitive drum 1, the developer is allowed to pass through the development region in a napped state, whereby an electric field between the leading end of the developer and the photosensitive drum 1 is stably increased, and thus, high image quality can be obtained. To generate such condition, it is general that the peak position of the magnetic flux density Br of the development pole in the normal direction is located near the drum nearest point. In view of this, in the present embodiment, the drum nearest angle θd and the peak angle θp are located on the same position.

Note that the specific angles of the respective positions and the magnetic flux density Br are as illustrated in Table 1 below.

TABLE 1

| | Angle (°) | Magnetic flux density Br (mT) |
|---|---|---|
| θa | 155 | 40.5 |
| θb | 160 | 39 |
| θc | 165 | 37.6 |
| θd | 90 | 80 |
| θp | 90 | 80 |

In addition, an absolute value of an average rate of change of the magnetic flux density Br of the magnetic pole S1 within the range (regulation region) of ±5° (between θa to θc) based on the blade nearest angle θb (with the blade nearest angle θb as a center) is defined as r. Further, an absolute value of an average rate of change of the magnetic flux density Br of the magnetic pole S1 between the drum nearest angle θd and the blade nearest angle θb is defined as R. That is, the absolute values r and R of the average rates of change are represented by the following equations 1 and 2.

$$r=|(Br(\theta a)-Br(\theta c))/(\theta a-\theta c)| \quad (1)$$

$$R=|(Br(\theta d)-Br(\theta b))/(\theta d-\theta b)| \quad (2)$$

In the equations 1 and 2, Br(θ) indicates the magnetic flux density Br on the development sleeve 26 at the angle θ. In addition, the average rate of change is calculated with the unit of the magnetic flux density Br being mT, and the angle being based on degree measure. Further, in the description below, the absolute value r of the average rate of change is referred to as an average rate of change r, and the absolute value R of the average rate of change is referred to as an average rate of change R, for the sake of convenience of the description.

The case where the average rate of change r is large indicates that the change in the magnetic flux density Br of the magnetic pole S1 near the development blade 23 is rapid. In this case, the fluctuation in the arctan (Br/Bθ) based on the component tolerance of the magnet roller 25 increases, so that the fluctuation in the regulation amount of developer on the development sleeve 26 increases.

In view of this, the development device 4 according to the present embodiment is configured such that the change in the magnetic flux density Br is slow within ±5° which is the maximum fluctuation of the magnetic flux density Br, due to the component tolerance of the magnet roller 25, on the position of the development blade 23. Specifically, the average rate of change r of the magnetic flux density Br of the magnetic pole S1 within ±5° based on the blade nearest angle θb is set to be smaller than the average rate of change from the position where the magnetic flux density Br of the magnetic pole S1 is zero to the peak position.

When the peak of the magnetic flux density Br of the magnetic pole S1 is present within the range of ±5° based on the blade nearest angle θb, the change in the magnetic flux density Br may be rapid, even when the average rate of change r is small. Therefore, the peak position of the magnetic flux density of the magnetic pole S1 needs to be set outside of the range of ±5° based on the blade nearest angle θb.

Notably, in the present embodiment, the magnetic pole S1 serves as both the development pole and the regulation pole. Therefore, the development blade 23 is located on the position where the magnetic flux density Br is increasing to the peak position. However, the present invention also includes the configuration in which the development pole and the regulation pole are different from each other. In this configuration, the development blade 23 may be disposed on the position where the magnetic flux density Br is decreasing from the peak. In view of this, the absolute values of the average rates of change, which are to be compared, are employed.

In addition, there are absolute values of two average rates of change from the position where the magnetic flux density Br of the magnetic pole S1 is zero to the peak position: the absolute value of the average rate of change in the region where the magnetic flux density Br is increasing; and the absolute value of the average rate of change in the region where the magnetic flux density Br is decreasing, across the peak. Here, the reason for comparing the average rates of change is to make the change in the magnetic flux density Br slow on the position facing the development blade 23. In view of this, the absolute value of the average rate of change from the position where the magnetic flux density Br of the magnetic pole S1 is zero to the peak position means the absolute value of the average rate of change in the region where the development blade 23 is disposed, out of the region where the magnetic flux density Br is increasing and the region where the magnetic flux density Br is decreasing.

In the present embodiment, the average rate of change r is 0.29. In addition, the average rate of change from the position where the magnetic flux density Br of the magnetic pole S1 is zero to the peak position is 0.81. Therefore, the average rate of change r of the magnetic flux density Br of the magnetic pole S1 in the region of ±5° based on the blade nearest angle θb is smaller than the average rate of change from the position where the magnetic flux density Br of the magnetic pole S1 is zero to the peak position. Further, the peak angle θs is set outside of the region of ±5° based on the blade nearest angle θb.

According to this configuration, the fluctuation in the napping angle of the developer near the development blade 23 due to the influence of the component tolerance of the magnet roller 25 can be reduced. Therefore, the fluctuation in the regulation amount of the developer on the development sleeve 26 can be reduced, and thus, the coating amount of the developer on the development sleeve 26 can be stabilized. In addition, a developer layer having uniform ear length can be conveyed to the development region.

Notably, the fluctuation in the coating amount of the developer on the development sleeve 26 is desirably within the range of ±5 mg/cm$^2$, and to achieve this range, the average rate of change r needs to be set to be less than 1.0.

Furthermore, the fluctuation in the coating amount of the developer on the development sleeve 26 is more desirably within the range of ±3 mg/cm$^2$. The experiment conducted by the present inventor has shown that the fluctuation in the coating amount of the developer on the development sleeve 26 can be kept within ±3 mg/cm$^2$ by setting the fluctuation in the magnetic force to be less than or equal to 3 mT on the position where the development sleeve 26 faces the development blade 23.

Specifically, it is necessary to set the average rate of change r to be less than 0.3 in order to keep the fluctuation in the magnetic force at 3 mT with respect to the above-mentioned fluctuation of ±5° in the magnetic flux density Br. Accordingly, in the present embodiment, the average rate of change r is set to be 0.29 which is less than 0.3. Thus, the fluctuation in the coating amount of the developer on the development sleeve 26 can be within the range of ±3 mg/cm$^2$.

In addition, magnetic force of at least 80 mT is generally needed as the magnetic force in the development region. If the magnetic force in this region falls below 80 mT, there is concern that carriers are deposited onto the photosensitive drum 1 or the developer is stagnant between the photosensitive drum 1 and the development sleeve 26. On the other hand, the magnetic force is desirably less than or equal to 45 mT on the position where the development sleeve 26 faces the development blade 23. This is because, if the magnetic force is too high on the position where the development sleeve 26 faces the development blade 23, the developer might be deteriorated due to torque through durability.

In the present embodiment, the angle between the blade nearest angle θb and the drum nearest angle θd is 70°. Therefore, to set the magnetic force in the development region to be more than or equal to 80 mT and to set the magnetic force on the position where the development sleeve 26 faces the development blade 23 to be less than or equal to 45 mT, the average rate of change R needs to be set to a value larger than 0.5. Accordingly, in the present embodiment, R is set to be 0.59 which is larger than 0.5. Thus, the carrier bearing force of the magnetic pole S1 is increased, whereby the deposition of carriers on the surface of the photosensitive drum 1 can be suppressed. In addition, deterioration of the developer due to torque can be suppressed.

Note that the average rates of change r and R can be decreased in the similar manner by applying other conditions of the main body of the development device 4, and according to this, the similar effect can be obtained.

<Result of Experiment>

Next, the result of an experiment will be described below with reference to a table in FIG. 7. In this experiment, the difference in coating amounts of developer on the development sleeve 26 due to fluctuation in the peak position of the magnetic flux density Br of the magnetic pole S1, which is the regulation pole, are compared between the development device 4 according to the present embodiment and a development device according to a comparative example.

Figure 8:
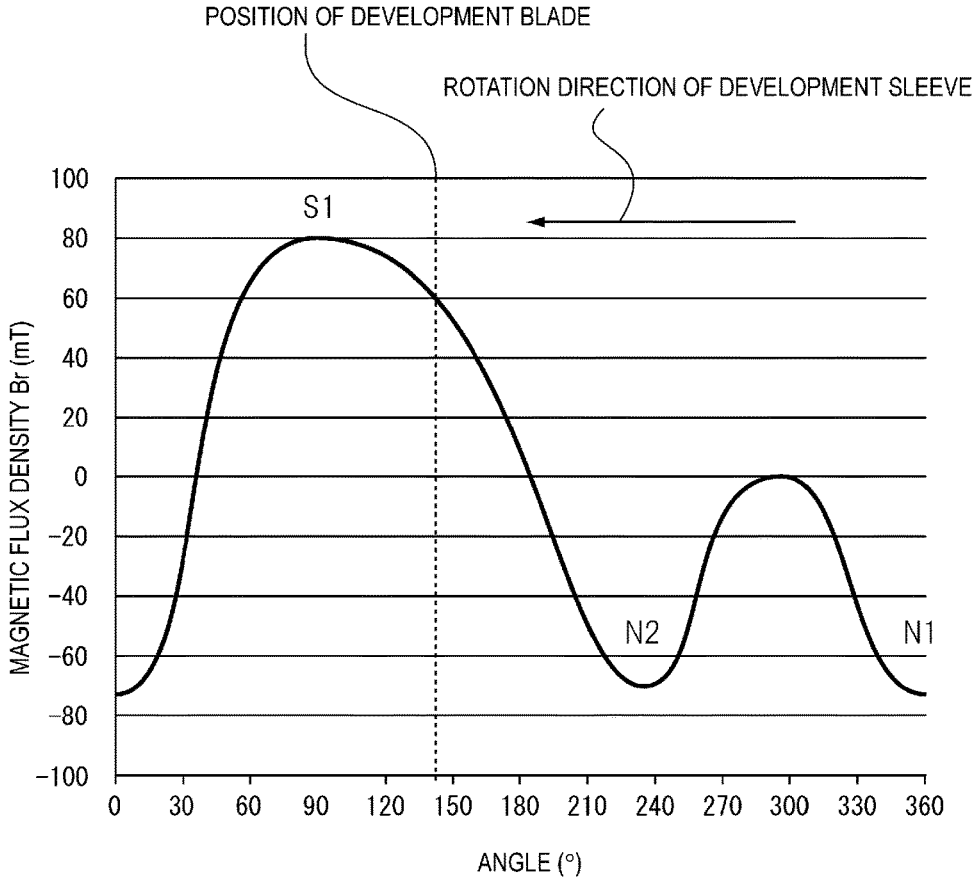
FIG. 8 is a graph illustrating a distribution of a magnetic flux density in the normal direction relative to the surface of a development sleeve in a development device according to a comparative example.

FIG. 8 is a graph illustrating the distribution of a magnetic flux density Br exerted from a magnet roller in the development device according to the comparative example. As illustrated in FIG. 8, in the development device according to the comparative example, the change in the magnetic flux density Br of the magnetic pole S1 around the development blade 23 is more rapid than that in the development device 4 according to the present embodiment. Notably, an angle indicated by the horizontal axis in FIG. 8 is set to increase in the clockwise direction along the circumferential direction of the development sleeve 26 with the angle just below the rotation center of the development sleeve 26 in FIG. 2 in the vertical direction being defined as 0°, as in the graph in FIG. 5A. In addition, the magnetic flux density Br is set such that the S-pole side is positive. Further, the configuration of the development device according to the comparative example other than the distribution of the magnetic flux density Br is the same as that of the development device 4 according to the present embodiment.

As illustrated in FIG. 7, in the development device according to the comparative example, the fluctuation in the coating amount of the developer on the development sleeve was more than or equal to ±3 mg/cm$^2$, when the magnetic flux density Br on the position of the development blade varied by ±5°. On the other hand, in the development device 4 according to the present embodiment, the fluctuation in the coating amount of the developer on the development sleeve 26 could be kept not more than ±3 mg/cm$^2$. In addition, the deposition of carriers on the photosensitive drum 1 was visually evaluated, wherein O indicates good, and X indicates not allowable. The evaluation result was on the same level and good in both the configuration according to the present embodiment and the configuration according to the comparative example.

It is also found from the result of the experiment that the development device 4 according to the present embodiment can stabilize the amount of developer conveyed to the development region. It is also found that the deposition of carriers on the photosensitive drum 1 can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-094612, filed May 10, 2016, which is hereby incorporated by reference herein in its entirety.

What is claimed is:

1. A development device that forms a toner image on an image bearing member, the development device comprising:

a developer bearing member that is rotatable and carries developer including magnetic particles and toner;

a regulation portion that is disposed to face the developer bearing member for regulating an amount of developer carried on the developer bearing member;

a magnetic field generation member that is provided inside of the developer bearing member, the magnetic field generation member having: a development pole facing the image bearing member; a first magnetic pole which is disposed downstream of the development pole with respect to a rotation direction of the developer bearing member on a position adjacent to the development pole and has a polarity different from a polarity of the development pole; and a second magnetic pole which is disposed upstream of the development pole with respect to the rotation direction of the developer bearing member on a position adjacent respectively to the development pole and the first magnetic pole and has a polarity different from the polarity of the development pole;

wherein the magnetic field generation member has a region satisfying $|(Br(\theta a)-Br(\theta c))/10|<0.3$, wherein $Br(\theta a)$ is a magnetic flux density in a normal direction relative to a surface of the developer bearing member on a position shifted by −5° from a point nearest to the regulation portion on the developer bearing member around a center of the developer bearing member, and $Br(\theta c)$ is the magnetic flux density around the developer bearing member on a position shifted by +5° from the point nearest to the regulation portion on the developer bearing member.

2. The development device according to claim 1, wherein $|(Br(\theta d)-Br(\theta b))/(\theta d-\theta b)|>0.5$ is satisfied, wherein $Br(\theta d)$ is the magnetic flux density of the development pole on the peak position of the magnetic flux density, $Br(\theta b)$ is the magnetic flux density on the point nearest to the regulation portion, $\theta b$ is an angle between the point nearest to the regulation portion on the developer bearing member and a predetermined point, around the center of the developer bearing member, and $\theta d$ is an angle between the point on the peak position of the magnetic flux density of the development pole and the predetermined point, around the center of the developer bearing member.

3. A development device that forms a toner image on an image bearing member, the development device comprising:

a developer bearing member that is rotatable and carries developer including magnetic particles and toner;

a regulation portion that is disposed to face the developer bearing member for regulating an amount of developer carried on the developer bearing member;

a magnetic field generation member that is provided inside of the developer bearing member, the magnetic field generation member having: a development pole facing the image bearing member; a first magnetic pole which is disposed downstream of the development pole with respect to a rotation direction of the developer bearing member on a position adjacent to the development pole and has a polarity different from a polarity of the development pole; and a second magnetic pole which is disposed upstream of the development pole with respect to the rotation direction of the developer bearing member on a position adjacent respectively to the development pole and the first magnetic pole and has a polarity different from the polarity of the development pole;

wherein $|(Br(\theta a)-Br(\theta c))/10|$ is smaller than $|Br(\theta d)/(\theta d-\theta e)|$, wherein $\theta d$ is an angle between a point on a peak position of a magnetic flux density of the development pole in a normal direction relative to a surface of the developer bearing member and a predetermined point, around a center of the developer bearing member, $\theta e$ is an angle between the predetermined point and a point which is upstream of the regulation portion in the rotation direction of the developer bearing member and at which the magnetic flux density is zero, around the center of the developer bearing member, $Br(\theta a)$ is the magnetic flux density on a position shifted by −5° from a point nearest to the regulation portion on the developer bearing member, around the center of the developer bearing member, Br(θc) is the magnetic flux density on a position shifted by +5° from the point nearest to the regulation portion on the developer bearing member, around the center of the developer bearing member, and Br(θd) is the magnetic flux density on the peak position of the magnetic flux density of the development pole.

4. The development device according to claim 3, wherein $|(Br(\theta_a)-Br(\theta_c))/10|<0.3$ is satisfied.

5. The development device according to claim 3, wherein $|(Br(\theta_d)-Br(\theta_b))/(\theta_d-\theta_b)|>0.5$ is satisfied, wherein $Br(\theta_b)$ is the magnetic flux density on a point nearest to the regulation portion, $\theta_b$ is an angle between the point nearest to the regulation portion on the developer bearing member and a predetermined point, around the center of the developer bearing member.

6. An image forming apparatus comprising:

an image bearing member; and a development device that forms a toner image on the image bearing member, the development device comprising:

a developer bearing member that is rotatable and carries developer including magnetic particles and toner;

a regulation portion that is disposed to face the developer bearing member for regulating an amount of developer carried on the developer bearing member;

a magnetic field generation member that is provided inside of the developer bearing member, the magnetic field generation member having: a development pole facing the image bearing member; a first magnetic pole which is disposed downstream of the development pole with respect to a rotation direction of the developer bearing member on a position adjacent to the development pole and has a polarity different from a polarity of the development pole; and a second magnetic pole which is disposed upstream of the development pole with respect to the rotation direction of the developer bearing member on a position adjacent respectively to the development pole and the first magnetic pole and has a polarity different from the polarity of the development pole;

wherein the magnetic field generation member has a region satisfying $|(Br(\theta a)-Br(\theta c))/10|<0.3$, wherein Br(θa) is a magnetic flux density in a normal direction relative to a surface of the developer bearing member on a position shifted by −5° from a point nearest to the regulation portion on the developer bearing member around a center of the developer bearing member, and Br(θc) is the magnetic flux density around the developer bearing member on a position shifted by +5° from the point nearest to the regulation portion on the developer bearing member.

7. An image forming apparatus comprising:

an image bearing member; and a development device that forms a toner image on the image bearing member, the development device comprising:

a developer bearing member that is rotatable and carries developer including magnetic particles and toner;

a regulation portion that is disposed to face the developer bearing member for regulating an amount of developer carried on the developer bearing member;

a magnetic field generation member that is provided inside of the developer bearing member, the magnetic field generation member having: a development pole facing the image bearing member; a first magnetic pole which is disposed downstream of the development pole with respect to a rotation direction of the developer bearing member on a position adjacent to the development pole and has a polarity different from a polarity of the development pole; and a second magnetic pole which is disposed upstream of the development pole with respect to the rotation direction of the developer bearing member on a position adjacent respectively to the development pole and the first magnetic pole and has a polarity different from the polarity of the development pole;

wherein $|(Br(\theta a)-Br(\theta c))/10|$ is smaller than $|Br(\theta d)/(\theta d-\theta e)|$, wherein θd is an angle between a point on a peak position of a magnetic flux density of the development pole in a normal direction relative to a surface of the developer bearing member and a predetermined point, around a center of the developer bearing member, θe is an angle between the predetermined point and a point which is upstream of the regulation portion in the rotation direction of the developer bearing member and at which the magnetic flux density is zero, around the center of the developer bearing member, Br(θa) is the magnetic flux density on a position shifted by −5° from a point nearest to the regulation portion on the developer bearing member, around the center of the developer bearing member, Br(θc) is the magnetic flux density on a position shifted by +5° from the point nearest to the regulation portion on the developer bearing member, around the center of the developer bearing member, and Br(θd) is the magnetic flux density on the peak position of the magnetic flux density of the development pole.

* * * * *